US010133219B2

(12) United States Patent
Kawai

(10) Patent No.: US 10,133,219 B2
(45) Date of Patent: Nov. 20, 2018

(54) IMAGE HEATING APPARATUS THAT DETECTS A CRACK IN A FIXING BELT BASED ON A DIFFERENCE IN DETECTION TEMPERATURE BETWEEN A FIRST DETECTOR AND A SECOND DETECTOR

(71) Applicant: CANON KABUSHIKI KAISHA, Tokyo (JP)

(72) Inventor: Hiroki Kawai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/905,154

(22) Filed: Feb. 26, 2018

(65) Prior Publication Data

US 2018/0188672 A1 Jul. 5, 2018

Related U.S. Application Data

(63) Continuation of application No. PCT/JP2016/075736, filed on Aug. 26, 2016.

(30) Foreign Application Priority Data

Aug. 27, 2015 (JP) ..... 2015-167620

(51) Int. Cl.
*G03G 15/20* (2006.01)
*G03G 15/00* (2006.01)

(52) U.S. Cl.
CPC ..... *G03G 15/205* (2013.01); *G03G 15/2078* (2013.01); *G03G 15/2089* (2013.01); *G03G 15/55* (2013.01); *G03G 2215/2041* (2013.01)

(58) Field of Classification Search
CPC ..... G03G 15/205; G03G 15/2078; G03G 15/2089; G03G 15/55; G03G 2215/2041
See application file for complete search history.

(56) References Cited

U.S. PATENT DOCUMENTS

| | | | | |
|---|---|---|---|---|
| 8,265,495 | B2 | 9/2012 | Sato | |
| 9,235,182 | B2 * | 1/2016 | Fukushi | G03G 15/70 |
| 9,864,311 | B2 * | 1/2018 | Sueyoshi | G03G 15/2039 |

FOREIGN PATENT DOCUMENTS

| | | | |
|---|---|---|---|
| JP | 2008-058645 | A | 3/2008 |
| JP | 2009-223058 | A | 10/2009 |
| JP | 2010-134035 | A | 6/2010 |
| JP | 2010-266694 | A | 11/2010 |
| JP | 2011-237481 | A | 11/2011 |
| JP | 2014-016411 | A | 1/2014 |
| WO | 2017/034042 | A | 3/2017 |

OTHER PUBLICATIONS

International Search Report and Written Opinion dated Oct. 25, 2016, issued in corresponding International Patent Application No. PCT/JP2016/075736.

* cited by examiner

*Primary Examiner* — Hoang Ngo
(74) *Attorney, Agent, or Firm* — Fitzpatrick, Cella, Harper & Scinto

(57) ABSTRACT

An image heating apparatus includes an endless belt for heating a toner image on a sheet, a first detector for detecting a temperature of one longitudinal end portion of the endless belt, a second detector for detecting a temperature of the other longitudinal end portion of the endless belt, and a controller for controlling whether notification of generation of an error is provided on the basis of a change amount per unit time of a difference between the temperature detected by the first detector and the temperature detected by the second detector.

11 Claims, 8 Drawing Sheets

IMAGE HEATING APPARATUS THAT DETECTS A CRACK IN A FIXING BELT BASED ON A DIFFERENCE IN DETECTION TEMPERATURE BETWEEN A FIRST DETECTOR AND A SECOND DETECTOR

This application is a continuation of International Patent Application No. PCT/JP2016/075736, filed Aug. 26, 2016, which claims the benefit of Japanese Patent Application No. 2015-167620, filed on Aug. 27, 2015, which are incorporated by reference herein in their entireties.

TECHNICAL FIELD

The present invention relates to an image heating apparatus for heating a toner image on a recording material.

Conventionally, in the image forming apparatus of an electrophotographic type, a toner image formed on a recording material (sheet) is heated and pressed, and is thus fixed by a fixing device (image heating apparatus).

Then, in recent years, from viewpoints of a quick start property and an energy saving property, a fixing device using a fixing belt (film) thin and small in thermal capacity has been put into practical use.

In such a fixing device using the thin fixing belt, there is a liability that a crack generates at a longitudinal end portion of the fixing belt. For example, there is a rare case in which the recording material fastened with a staple is introduced into the fixing device, and the fixing belt is damaged, and thus, the crack generates. Even in such a rare case, it has been required that the crack of the fixing belt can be detected quickly.

Therefore, a technique in which a thermistor for detecting one longitudinal end portion of the fixing belt is provided, and, when a detection temperature of the thermistor is below a predetermined temperature, abnormality of the fixing device is detected has been proposed (Japanese Laid-Open Patent Application (JP-A) 2010-134035).

Further, a technique in which thermistors for detecting temperatures at one longitudinal end portion and the other longitudinal end portion, respectively, of a fixing belt, and, when a temperature difference then is a predetermined temperature difference, the predetermined temperature difference being set in advance, discrimination that breakage of the fixing belt generated is made has been proposed (JP-A 2014-16411).

In a method proposed in JP-A 2010-134035, when the crack is generated in the fixing belt, it takes a time until the detection temperature by the thermistor lowers to the predetermined temperature, and, therefore, it becomes difficult to detect the temperature early.

Further, in a method proposed in JP-A 2014-16411, there is a liability that, in the case in which an introducing position of the recording material shifts from a reference position toward one longitudinal end side of the fixing belt, erroneous detection is made. This is because, even in the case in which the crack does not generate in the fixing belt, a detection temperature difference between both the thermistors reaches a predetermined temperature difference, and thus, erroneous detection such that the crack generated in the fixing belt is made.

SUMMARY OF THE INVENTION

According to one aspect, the present invention provides an image heating apparatus comprising an endless belt for heating a toner image on a sheet, a first detector for detecting a temperature of one longitudinal end portion of the endless belt, a second detector for detecting a temperature of the other longitudinal end portion of the endless belt, and a controller for controlling whether or not notification of generation of an error is provided on the basis of a change amount per unit time of a difference in detection temperature between the first detector and the second detector.

DETAILED DESCRIPTION OF EMBODIMENTS OF THE INVENTION

Preferred embodiments of the present invention will be described below with reference to the drawings.

First Embodiment

Image Forming Apparatus

Figure 2:
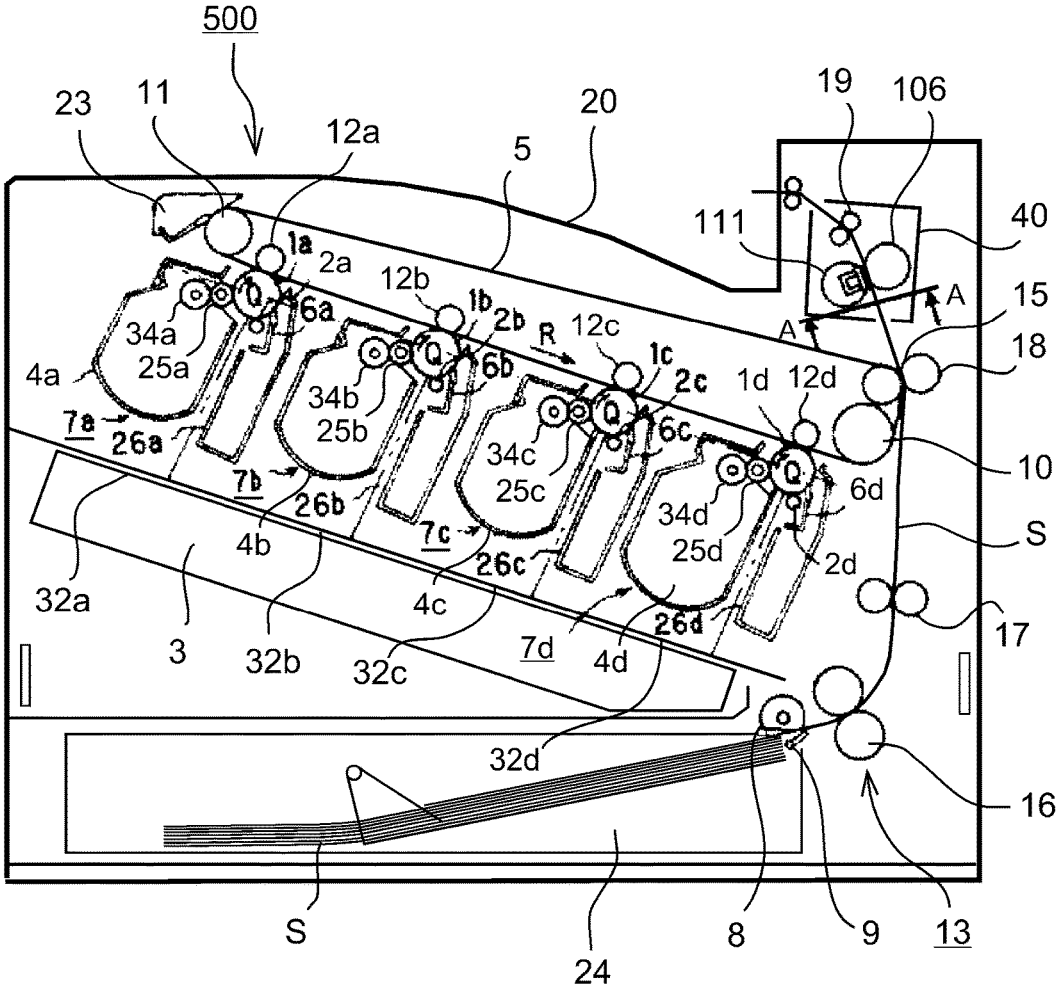
FIG. 2 is a sectional view of an image forming apparatus in which the fixing device is mounted.

FIG. 2 is a sectional view of an image forming apparatus 500 in which a fixing device is mounted. Four cartridges 7 (7*a*-7*d*) that are juxtaposed obliquely with respect to an up-down direction include photosensitive drum units 26 (26*a*-26*d*) having photosensitive drums 1 (1*a*-1*d*) as electrophotographic photosensitive members, and include developing units 4 (4*a*-4*d*).

The photosensitive drums 1 are rotationally driven in a clockwise direction (i.e. a direction of an arrow Q) in FIG. 2 by a driving member (not shown). At peripheries of the photosensitive drums 1, in the order of a rotational direction thereof, cleaning members 6 (6*a*-6*d*), charging rollers 2 (2*a*-2*d*) and the developing units 4 are provided. The cleaning members 6 remove toner agents remaining on the photosensitive drums 1 after the toner images are transferred from the photosensitive drums 1 onto an intermediary transfer belt 5. The toner agents removed by the cleaning members 6 are collected in toner chambers in photosensitive member units 26 (26*a*-26*d*).

The charging rollers 2 electrically charge surfaces of the photosensitive drums 1 uniformly. After the surfaces of the photosensitive drums 1 are charged by the charging rollers 2, the surfaces of the photosensitive drums 1 are exposed to laser light from a scanner unit (exposure means) 3 through unit openings 32 (32*a*-32*d*). As a result, electrostatic latent images are formed on the surfaces of the photosensitive drums 1. In this embodiment, the scanner unit 3 is disposed below the cartridge 7.

The developing units 4 supply the toner agents to the electrostatic latent images formed on the photosensitive drums 1 and develop the electrostatic latent images into the toner images. The developing units 4 include developing rollers 25 (25*a*-25*d*) for supplying the toner agents to the surfaces of the photosensitive drums 1 and in contact with the photosensitive drums 1, and supplying rollers 34 (34*a*-34*d*) for supplying the toner agents to the surfaces of the developing rollers 25 and in contact with the developing rollers 25.

When the image is formed on a recording material S, first, the electrostatic latent images formed on the surfaces of the photosensitive drums 1 by the scanner unit 3 are developed into the toner images by the cartridges 7 and then are transferred onto the intermediary transfer belt 5.

The intermediary transfer belt 5 is stretched by a driving roller 10 and a tension roller 11, and is driven in an arrow R direction in FIG. 2. Inside the intermediary transfer belt 5, primary transfer rollers 12 (12*a*-12*d*) are provided opposed to the photosensitive drums 1, and to the primary transfer rollers 12, transfer biases are applied by unshown bias applying means. For example, in the case in which negatively charged toner agents are used, by applying positive biases to the primary transfer rollers 12, the toner images are successively transferred onto the intermediary transfer belt 5.

Then, the four color toner images are fed to a secondary transfer portion 15 in a state in which four color toner images are superposed on the intermediary transfer belt 5. At this time, the toner agents remaining on the intermediary transfer belt 5 after the secondary transfer onto the recording material S are removed by a transfer belt cleaning device 23, and the removed toner agents pass through a residual (waste) toner feeding path (not shown) and are collected by a residual (waste) toner collecting container (not shown).

On the other hand, in synchronism with an image forming operation described above, the recording material S is fed toward the secondary transfer portion 15 by a feeding mechanism including a feeding device 13, a registration roller pair 17, and the like. The feeding device 13 includes a feeding cassette 24 for accommodating a plurality of recording materials S, a feeding roller 8, and a feeding roller pair 16 for feeding the fed recording material S.

The feeding cassette 24 is detachably mountable to the image forming apparatus 500. A user pulls out the feeding cassette 24 to demount the feeding cassette 24 from the image forming apparatus 500, and then sets the recording materials S in the feeding cassette 24 and inserts the feeding cassette 24 into the image forming apparatus 500, so that supply of the recording materials S is completed.

Of the recording materials S accommodated in the feeding cassette 24, the recording material S located in an uppermost portion is separated one by one by press-contact of the feeding roller 8 and a separation pad 9 with rotation of the feeding roller 8 (friction separation type), and then is fed to the feeding device 13. The recording material S fed from the feeding device 13 is fed to the secondary transfer portion 15 by the registration roller pair 17. At the secondary transfer portion 15, by applying a positive bias to a secondary transfer roller 18, it is possible to secondary-transfer the four color toner images from the intermediary transfer belt 5 onto the fed recording material S.

Then, the recording material (sheet) S is fed from the secondary transfer portion 15 to a fixing device 40 as an image heating apparatus, in which heat and pressure are applied to the images transferred on the recording material S, so that the images are fixed on the recording material S. Thereafter, the recording material S on which the toner images are fixed is discharged onto a discharge tray 20 by a discharging roller pair 19.

Image Heating Apparatus

Figure 1:
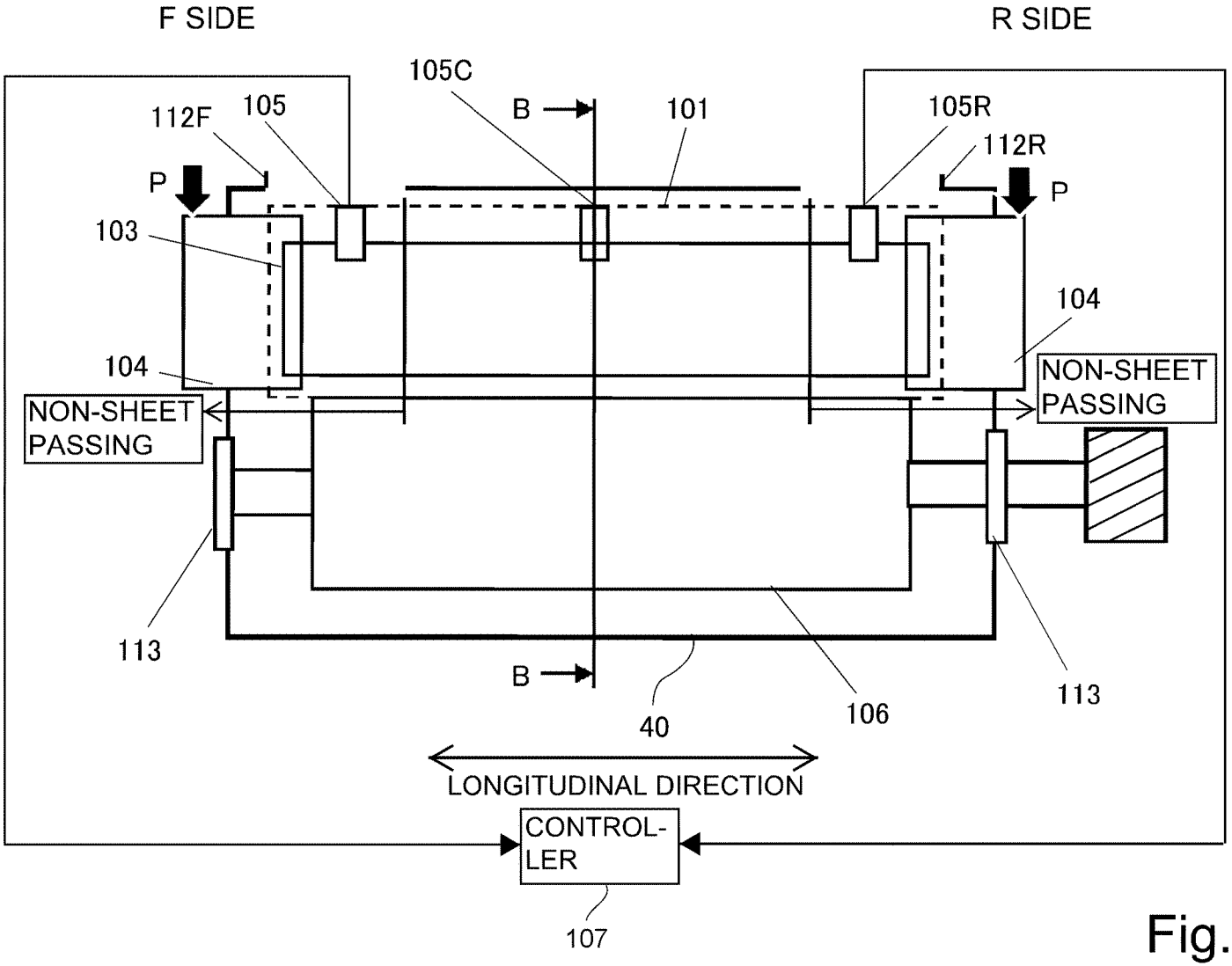
FIG. 1 is a sectional view of a fixing device.

Next, a structure of the fixing device 40 as the image heating apparatus in this embodiment will be described. The fixing device 40 includes a fixing belt (hereinafter, also referred to as a fixing film) 101. A sectional view (A-A sectional view of FIG. 2) of the fixing device 40 in this embodiment is shown in FIG. 1, and a sectional view (B-B sectional view of FIG. 1) of the fixing device 40 is shown in FIG. 3.

Figure 3:
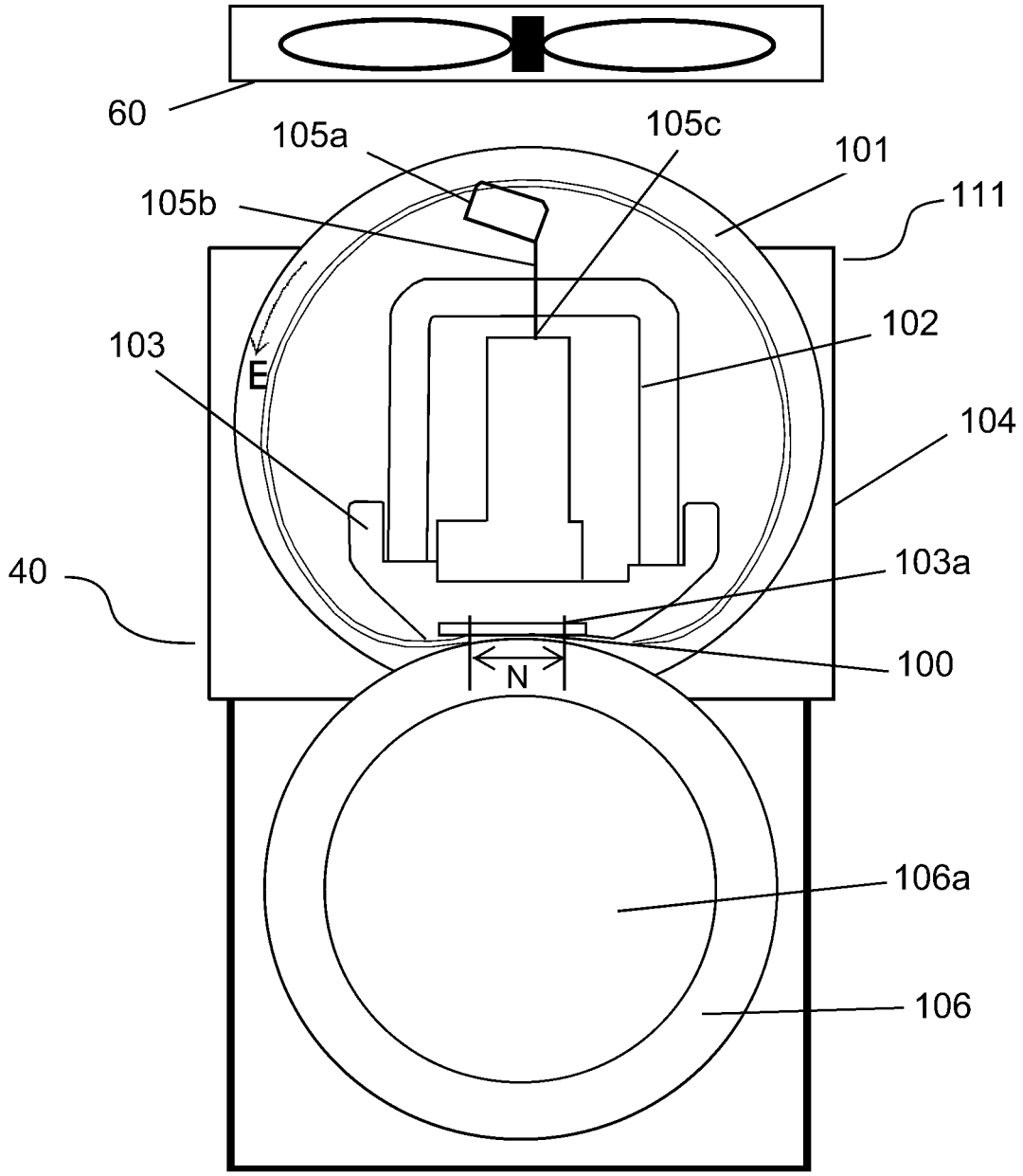
FIG. 3 is a sectional view of the fixing device.

As shown in FIG. 3, the fixing device 40 includes a pressing roller 106 as a pressing member (rotatable member), a ceramic heater 100 as a plate-shaped heater, and the fixing film 101. Further, the fixing device 40 includes fixing flanges (preventing portions) 104, provided at both longitudinal end portions of the fixing film 101, for preventing movement of the fixing film 101 in a longitudinal direction, and includes a press-contact member 103 for forming a nip N between itself and the pressing roller 106 sandwiching the fixing film 101 therebetween. Further, the fixing device 40 includes a stay 102 provided on an inner surface side of the fixing film 101 in order to ensure strength of the press-contact member 103.

Film Unit

Here, an assembly of the fixing film 101, the ceramic heater (hereinafter, referred to as a heater) 100, the press-contact member 103, the stay 102, thermistors 105 and the fixing flanges 104 is a film unit 111.

(1) Fixing Film

The fixing film 101 is a cylindrical heat-resistant fixing film as a heat-generating member for conducting heat to the recording material S, and is loosely fitted around the press-contact member 103. The fixing film 101 may desirably have a fixing thickness of 100 μm or less, preferably 50 μm or less and 20 μm or more, and may have a heat-resistant property in order to improve a quick start property by decreasing thermal capacity. Specifically, a single layer film of PEEK, PES, or FEP, or a composite layer film in which an outer peripheral surface of polyimide, polyamideimide, PEEK, PES, PPS, or the like, is coated with PTFE, PFA, FEP, or the like, can be used. Further, a film made of metal can also be used.

(2) Heater

The ceramic heater 100 is a heating means. The heater 100 has a basic structure including an elongated thin plate-like ceramic substrate and an energization heat generation resistor layer formed on a surface of the substrate, and is a low thermal capacity heater that increases in temperature with an abrupt temperature rise characteristic as a whole by energization to the heat generation resistor layer. The heater 100 is engaged in and is supported by an engaging groove 103*a* provided on a lower surface of the press-contact member 103 along the longitudinal direction of the press-contact member 103.

(3) Press-Contact Member

The press-contact member 103 is a heat-resistant and heat-insulating member of which a direction crossing a recording material feeding direction is a longitudinal direction, and that has a substantially arcuate (semi-circular) shape in cross section. The press-contact member 103 performs the functions of back-up of the fixing film 101, pressure application to the nip N formed by the press-contact of the pressing roller 106 with the fixing film 101, and feeding stability of the fixing film 101 during rotation of the fixing film 101. Further, as a material of the press-contact member 103, a material having good insulating and heat-resistant properties, such as phenolic resin, polyimide resin, polyamide resin, polyamideimide resin, PEEK resin, PES resin, PPS resin, PFA resin, PTFE resin, LCP resin, or the like, is used.

(4) Stay

The stay 102 is a member for imparting longitudinal strength to the press-contact member 103, and for rectifying the press-contact member 103 by being pressed against a back surface of the press-contact member 103 made of a relatively soft resin.

(5) Thermistor

The thermistor 105, as a detector, detects, on an inside of the fixing belt 101, a temperature of the fixing belt 101 (film) at a predetermined position with respect to a widthwise direction (longitudinal direction) of the fixing belt 101, and detects a fixing film inner surface temperature, and then feeds back the temperature to a controller 107 (FIG. 1). The thermistor 105 includes a temperature detecting element portion 105*a* for detecting the temperature in contact with a fixing film inner surface, and includes a leaf spring portion 105*b*, having elasticity, for being urged against the fixing film 101 with a predetermined contact pressure. Further, the thermistor 105 includes a holding portion 105*c* for being fixedly mounted and held by the press-contact member 103. This leaf spring portion 105*b* is made of stainless steel and also constitutes an electroconductive path of the temperature detecting element portion 105*a*.

(6) Fixing Flange

The fixing flanges (preventing portions) 104, shown in FIG. 3 and FIG. 1, are engaged with both ends of an assembly of the press-contact member 103 and the stay 102, and not only guide rotation of the fixing film 101, but also prevent slip-out of the fixing film 101. In Embodiment 1, to the fixing flanges 104 disposed at both ends of the fixing film 101, pressure (pressing force) is applied by pressing plates (not shown) rotatably attached to fixing frames 112, so that the film unit 111 and the pressing roller 106 are pressed in an arrow P direction of FIG. 1.

Pressing Member

In FIG. 3, the pressing roller 106 as a pressing member (rotatable member) is rotationally driven by transmitting drive thereto by an unshown fixing motor mounted in the image forming apparatus 500, so that the fixing film 101 is driven by the pressing roller 106, and thus is rotated in an arrow E direction of FIG. 3.

The pressing roller 106 is constituted by a metal core 106*a* made of a metal, and a heat-resistant elastic material layer that is molded and coated in a roller shape around the metal core 106*a* so as to be concentrically integral with the metal core 106*a*, and that is made of a silicone rubber, a fluorine-containing rubber, a fluorine-containing resin, or the like, and, as a surface layer, a parting layer is provided. For example, as a material of the parting layer, it is possible to select a material having a good parting property and a heat-resistant property, such as fluorine-containing resin, silicone resin, fluoro-silicone rubber, fluorine-containing rubber, silicone rubber, PFA, PTFE, FEP, or the like.

At both end portions of the metal core 106*a*, bearing members 113 (FIG. 1) made of a heat-resistant resin, such as PEEK, PPS, liquid crystal polymer, or the like, are mounted, and are rotatably held by and provided on side plates of the fixing frames 112.

Thermistor Arrangement

In this embodiment, three thermistors 105 are disposed along the longitudinal direction of the fixing film 101 shown by a broken line in FIG. 1, and a thermistor on a longitudinal left side (i.e., a longitudinal F side) is 105F, a thermistor in a central portion (i.e., a central side) is 105C, and a thermistor on a longitudinal right side (i.e., a longitudinal R side) is 105R. The thermistor 105C is a thermistor having a function of controlling a temperature (temperature control) of the fixing device 40, and controls energization to the heater 100 by a detection temperature. The thermistor 105F and the thermistor 105R are disposed symmetrically at longitudinal end sides of the fixing film 101 with respect to a longitudinal central portion. Specifically, the thermistor 105F and the thermistor 105R are symmetrically disposed at positions of 153 mm from the central portion with respect to the longitudinal direction, respectively.

In the case in which sheet feeding is carried out on a center (line) basis, when a maximum-sized sheet S is passed through the fixing nip N, if the sheet S passes through a central reference position, detection temperatures of the end portion thermistors 105F and 105R are both maintained at a certain temperature (170° C.). Further, if the sheet S passes through a shifted position, only the detection temperature of one of the thermistors 105F and 105R gradually increases.

Crack Detection Control Constitution

Figure 4:
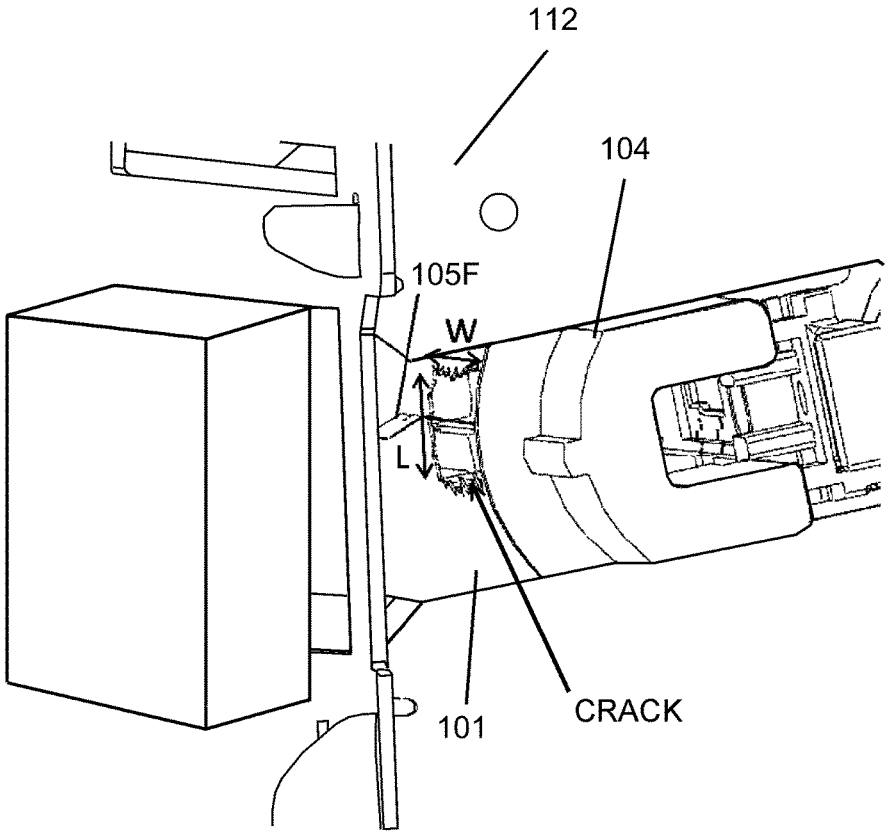
FIG. 4 is a schematic view of the fixing device in the case in which a crack generates.

Next, a control constitution in which, in the case in which the crack generated in the fixing film 101 during sheet passing of the fixing device 40 in this embodiment, crack generation is detected in association with the detection temperatures of the thermistors 105F and 105R will be described. In this embodiment, the case in which the sheet feeding was carried out on the center basis and the crack generated only at the F side end portion of the fixing film 101, as shown in FIG. 4, will be described as an example. A crack length with respect to the longitudinal direction of the fixing film 101 is W, and a crack length with respect to a circumferential direction of the fixing film is L.

The case in which, during the passing of the sheet S (A4 size of 105 gsm in this embodiment), the crack generates in the fixing film 101 and the crack length W with respect to the longitudinal direction reaches the position of the thermistor 105F will be described. Then, the thermistor 105F causes improper contact with the inner surface of the fixing film 101 or is exposed the fixing film 101, with the result that the detection temperature of the thermistor 105F abruptly lowers.

On the other hand, the thermistor 105R, provided at a longitudinal symmetrical position with respect to the thermistor 105F, continuously detects the temperature of the fixing film inner surface temperature-controlled constantly by temperature control, and, therefore, the detection temperature is maintained at a substantially constant temperature (about 190° C. in this embodiment).

At this time, a temperature difference between the thermistor 105F and the thermistor 105R increases. Further, in this embodiment, in the case in which a time change rate of an increase of this temperature difference is larger than a predetermined value, the crack is detected. The reason why the crack is detected based the time change rate of the temperature difference is that such detection is excellent from viewpoints of immediacy of the detection and prevention of erroneous detection, and this will be specifically described later.

As regards the contents of specific detection control, the temperature difference between the thermistor 105F and the thermistor 105R is $\Delta T$, and a fluctuation (increase or decrease) of ΔT per (one) second is ΔT/s, and, when ΔT/s>10° C./s is satisfied, discrimination that the crack occurs is made.

Detection Control Flowchart

Next, control of detecting the crack generation of the fixing film 101 in this embodiment will be described using a flowchart of FIG. 5. Incidentally, control other than that of the fixing device 40 in this embodiment will be omitted in this description.

Figure 5:
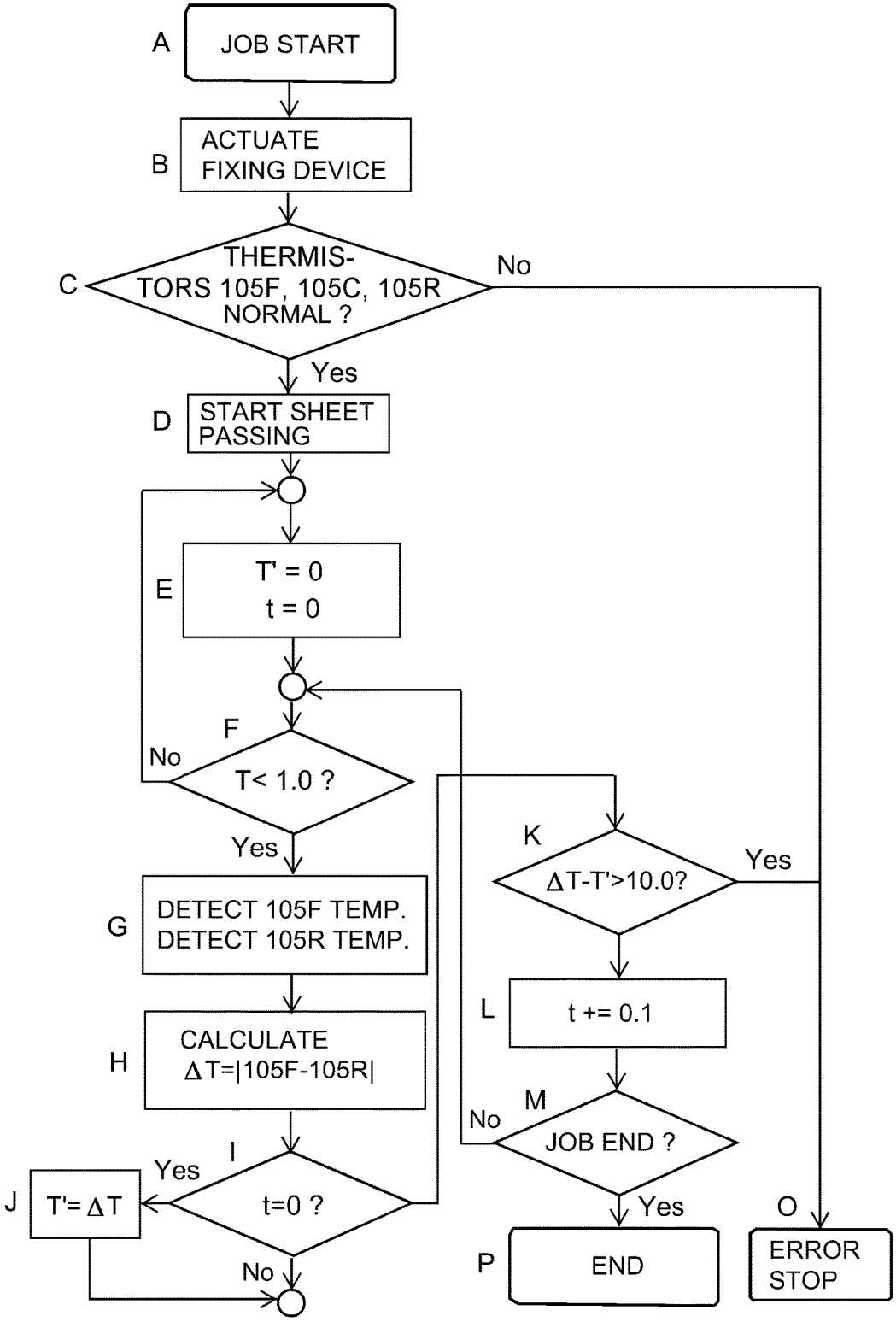
FIG. 5 is a flowchart for detecting error generation.

In FIG. 5, first, a job starts in step A. Then, energization to the heater 100 of the fixing device 40 is carried out, and the fixing motor is rotated, so that rising (actuation) of the fixing device 40 is carried out in step B. Next, whether or not the thermistors 105F, 105C, and 105R normally operate is checked in step C. In the case in which the thermistors 105F, 105C, and 105R do not normally operate, the fixing device 40 or the thermistors 105F, 105C, and 105R cause an abnormality, and, therefore, the image forming apparatus 500 is stopped (shut down) in step O. In the case in which the thermistors 105F, 105C, and 105R normally operate, sheet passing through the fixing device 40 is started in step D.

Here, as regards the control of detecting the crack generation of the fixing film 101 in this embodiment, discrimination of occurrence or non-occurrence of the crack (crack generation) is carried out per (one) second (data acquisition of the differential temperature ΔT is carried out per one tenth of a second, and, therefore, data acquisition is carried out ten times per second in which the discrimination is carried out).

In FIG. 5, in the case in which the sheet passing is started, an initial differential temperature variable between the thermistor 105F and the thermistor 105, that is a reference value of discrimination of one-second crack generation (discrimination of the occurrence or non-occurrence of the crack for one second) is defined as T', and an initial value of zero is assigned to T'. Further, an elapsed time counter (value) is defined as t, and an initial value of zero is assigned to t in step E. Here, in the case in which the elapsed time exceeds one second, the sequence goes to step E, and, in the case in which the elapsed time is less than one second, the sequence goes to steps G and F.

Then, every one tenth of one second, the detection temperatures of the thermistors 105F and 105R at that time are recorded, respectively, in step G. Further, an absolute value of a difference between the respective temperatures detected in step G is calculated and is assigned to the differential temperature ΔT in step H. Only in the case in which detection timing is an initial timing (t=0), ΔT calculated in step H is assigned to T'. This T' is a reference value for making a comparison as to whether ΔT is increased or decreased, and to what extent, for one second. In a one-second detection loop other than an initial one-second detection loop, the value of T' is not renewed and is a fixed value (ΔT calculated in step H), and the sequence goes to subsequent steps I and J.

Then, as discrimination of the one-second crack generation (discrimination of the occurrence or non-occurrence of the crack for one second), whether or not ΔT exceeds T' by more than 10° C. is discriminated in step K. In the case in which ΔT exceeds T' by more than 10° C. (in the case in which any of values of the differential temperature ΔT of ten times subjected to the data acquisition for one second falls under this condition), discrimination that the crack generated in the fixing film 101 in one second is made, and the image forming apparatus 500 is immediately stopped in step O.

On the other hand, in the case in which ΔT does not exceed T' by 10° C. or more (in the case in which any of values of the differential temperature ΔT of ten times subjected to the data acquisition for one second does not fall under this condition), discrimination that the crack does not generate in the fixing film 101 in one second is made. Then, the elapsed time counter t is incremented by one tenth of a second (whereby one new data of the differential temperature ΔT is added), and the sequence goes to a subsequent step L. Then, the steps E to L are repeated until the sheet passing ends in step M.

Figure 6:
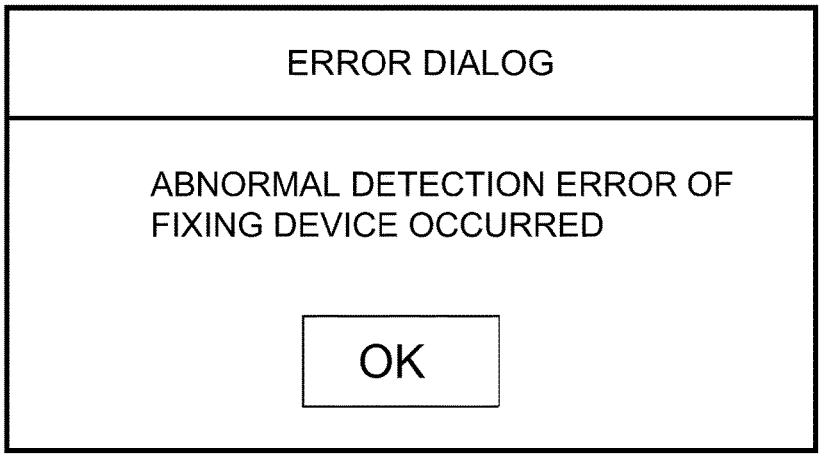
FIG. 6 is a schematic view showing an operating portion for providing notification of an abnormality.

Here, in the case in which the sequence leads to the step O, in which the image forming apparatus 500 stops, display as shown in FIG. 6 is made on a panel (not shown) mounted on the image forming apparatus 500, or on a monitor (not shown) connected with the image forming apparatus 500, so that a user is notified of an abnormality of the image forming apparatus 500. That is, in the step K, in the case in which ΔT exceeds T' by 10° C. or more, discrimination that the crack generated in the fixing film 101 is made, and the user is notified of warning.

Figure 7:
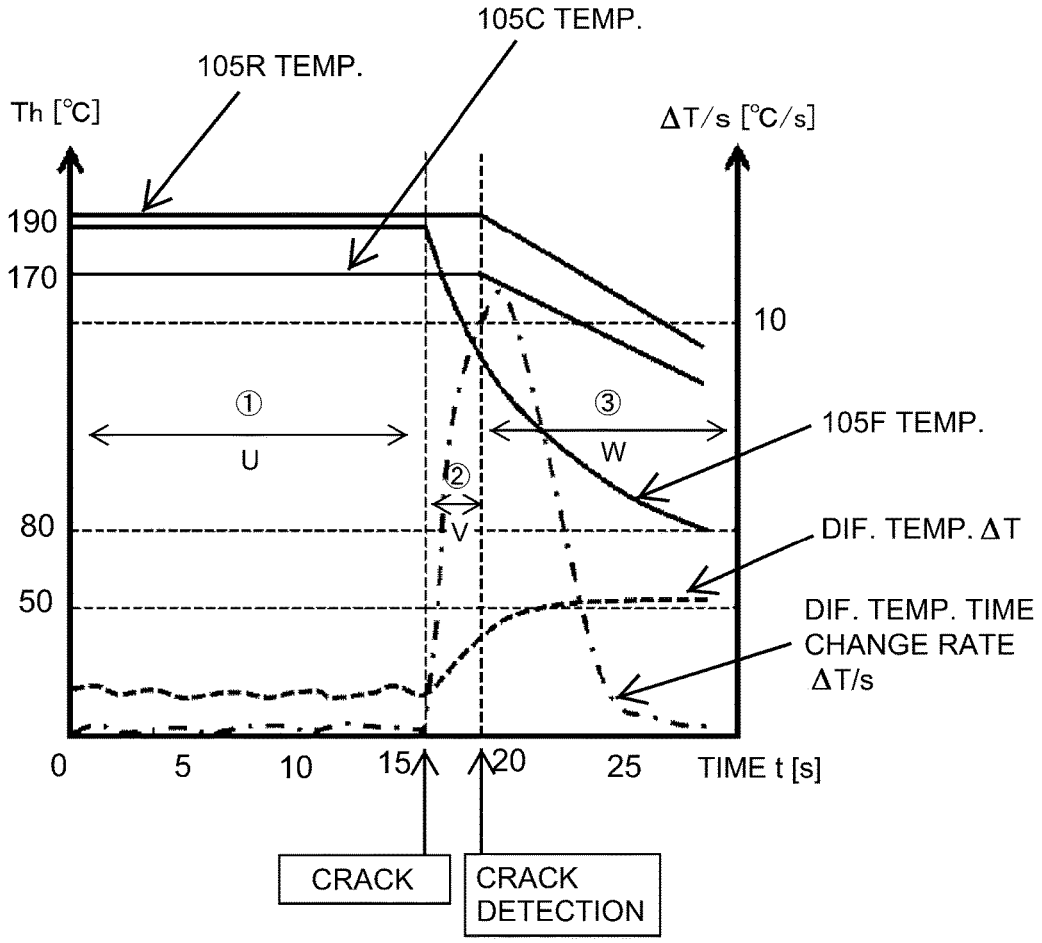
FIG. 7 is a graph showing a change of a detection temperature of a thermistor.

Thermistor Detection Temperature Change in Detection Control According to Present Embodiment In this embodiment, the detection temperatures of the thermistors 105F, 105R, and 105C from the generation of the crack during the sheet passing until the abnormality of the fixing film 101 is detected will be described using states of U, V, and W in FIG. 7. FIG. 7 is a graph showing the detection temperatures of the thermistors 105F, 105R and 105C, the detection temperature difference ΔT between the thermistors 105F and 105R, and the time change rate ΔT/s of ΔT. The abscissa represents a time t [s], a first ordinate (left side of FIG. 7) represents detection temperatures Th [° C.] of the thermistors 105F, 105R and 105C and of ΔT, and a second ordinate (right side of FIG. 7) represents a detection temperature [° C.] of the time change rate ΔT/s of ΔT.

First, a state U will be described. The state U represents a state in which the crack does not generate in the fixing film 101 and shows a state of the fixing device 40 during the sheet passing. The detection temperature of the thermistor 105C progresses in the neighborhood of 170° C. that is a control temperature, and the detection temperatures of the thermistors 105F and 105R progress in the neighborhood of 190° C. Further, the detection temperature difference of ΔT in this state is within 5° C., and ΔT/s is within 1° C./s.

Next, a state V will be described. The state V shows a state, changed from the state of U, in which the crack generated in the fixing film 101 during the sheet passing. The detection temperature of the thermistor 105F abruptly lowers, and ΔT and ΔT/s abruptly increase. Finally, a state W will be described. At a timing when ΔT/s exceeds 10° C./s from the state of V, notification that the fixing film 101 is in a state in which the crack generated is provided, and the image forming apparatus 500 is stopped.

Effectiveness Test of Detection Control According to Embodiment

As a timing of conventional control of detecting a fixing device abnormality during the sheet passing, timing when the detection temperature of the thermistor 105 is an abnormally low temperature (about 80° C. in this embodiment) during the temperature control (corresponding to the state U of FIG. 7) exists. Further, it is possible to cite the case in which the detection temperature difference (differential temperature difference ΔT) of the thermistors 105F and 105R abnormally increases (the differential temperature ΔT shown in FIG. 7 is about 50° C., for example). A comparison between such a conventional control and control (the differential temperature time change rate ΔT/s of FIG. 7) in this embodiment was checked with respect to the following items.

(1) Immediacy of Detection

Continuation of the operation in the state in which the crack generated in the fixing film 101 involves generation of various harmful influences, and, therefore, it is desirable that the image forming apparatus 500 is stopped immediately after the detection of the crack. From this viewpoint, a comparison of effectiveness in the above-described three states U, V, and W of control was made. When the respective temperature changes after the crack generation shown in FIG. 7 are checked, quickest detection of the crack is about 3 seconds in the control according this embodiment, and subsequent detection of the crack is about 7 seconds in the conventional control in which arrival of the differential temperature difference ΔT at 50° C. is detected. Further, slowest detection of the crack is made in the conventional control, in which detection that the detection temperature of the thermistor 105F is below 80° C. is made, so that it was confirmed that it takes a long time compared with the above-described control.

(2) Preventing Erroneous Detection

Next, a comparison test of an erroneous detection property in the following situation was conducted between the conventional control, in which the differential temperature of the respective thermistors is used as it is, and the control of this embodiment, in which the time change rate ΔT/s of the differential temperature ΔT of the respective thermistors 105, is used. In this comparison test, in a continuous sheet passing job, with respect to the fixing film longitudinal direction, the recording material (recording paper) S was shifted to one side and was subjected to sheet passing (one side-shifted sheet passing). Incidentally, the sheet S used in this embodiment is an A4-sized sheet of 105 gsm.

Figure 8:
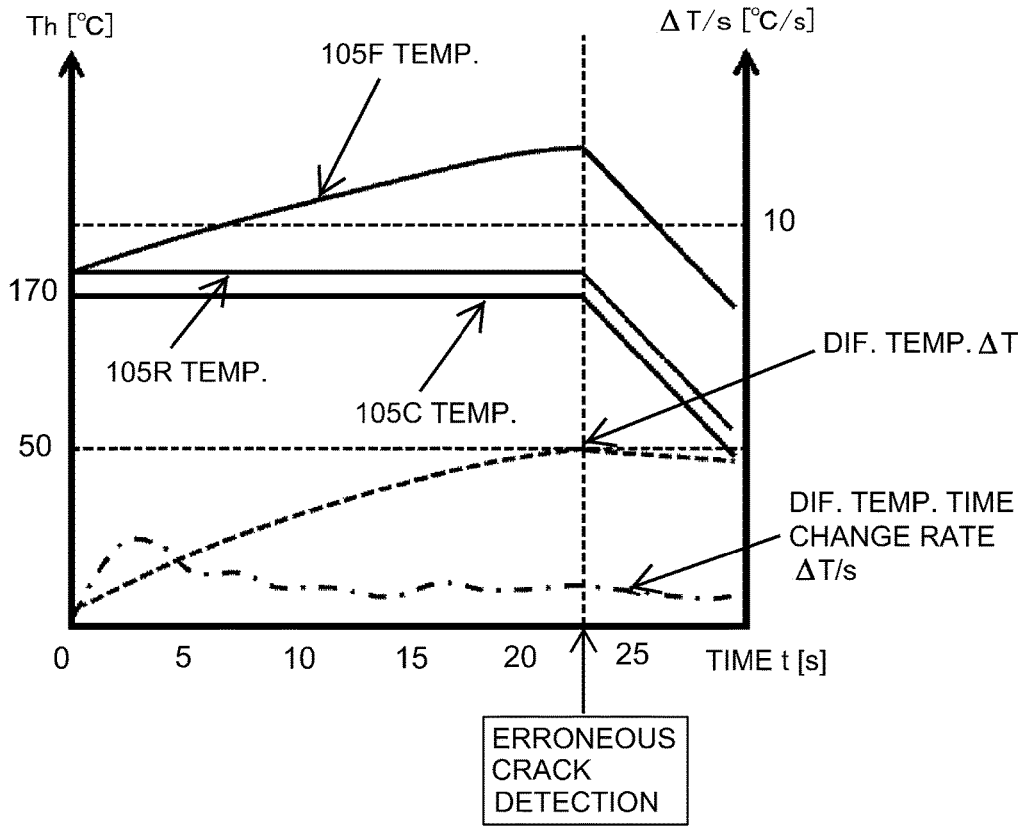
FIG. 8 is a graph showing changes of a detection temperature during passing of a sheet shifted toward one (longitudinal) end.

FIG. 8 is a graph showing respective changes of the detection temperatures of the thermistors 105F, 105R and 105C, the detection temperature difference ΔT of the thermistors 105F and 105R, and the time change rate ΔT/s of ΔT during the one side-shifted sheet passing.

When the recording material (recording paper) S is passed through the fixing device 40, the recording material S takes heat in a passing region (sheet-passing region) of the recording material (recording paper) S in the fixing film 101, but does not take heat in a non-passing region (non-sheet-passing region) of the recording material S, and, therefore, the temperature in the non-sheet-passing region is greater than the temperature in the sheet-passing region (non-sheet-passing portion temperature rise). Here, in the case in which the recording material (recording paper) S is shifted toward the thermistor 105R on the R side and is passed through the fixing device 40, a highest temperature portion by the non-sheet-passing portion temperature rise is asymmetrical with respect to the longitudinal direction, so that a difference generates in detection temperature between the thermistors 105F and 105R. The difference in detection between the thermistors 105F and 105R in FIG. 8 generates for this reason.

In the case in which the detection temperature difference ΔT due to such one side-shifted sheet passing generates, in the conventional control in which the differential temperature ΔT between the respective thermistors 105F and 105R is used as it is, and in the case in which the crack does not generate in the fixing film 101, the differential temperature reaches 50° C. in some cases (FIG. 8). That is, in this case, erroneous detection that the crack generated in the fixing film 101 is made. It was confirmed, however, that such erroneous detection does not generate in the control of this embodiment using the time change rate ΔT/s of the differential temperature ΔT between the respective thermistors 105F and 105R.

(3) Total Detection Performance

From the above description, when this embodiment using the fluctuation ΔT/s per one second of the temperature difference ΔT between the thermistor 105F and the thermistor 105R is applied to the image forming apparatus 500, it was confirmed that the immediacy of the crack detection of the fixing film 101 is excellent and also the erroneous detection preventing property is excellent.

Effect of this Embodiment

When the fixing device 40 to which this embodiment is applied is used, before the crack generated in the fixing film 101 causes damage to another component part, it becomes possible to quickly detect the crack of the fixing film 101 with no erroneous detection. For that reason, in the case in which the crack generated in the fixing film 101, it can be met by exchanging only the fixing film 101 or a component part (the pressing roller 106, for example) contacting the fixing film 101, so that it is possible to realize a reduction of downtime and improvement of reliability of the image forming apparatus 500.

Modified Embodiments

In the above-described embodiment, a preferred embodiment of the present invention was described, but the present invention is not limited thereto, and can also be variously modified within the scope of the invention.

Modified Embodiment 1

In the above-described embodiment, the case in which the crack generated in the fixing film 101 during the sheet passing and the crack length W with respect to the longitudinal direction reaches the position of the thermistor 105F was described, but similar detection can be made even when the crack length W does not reach the position of the thermistor 105F. That is, when the crack generates as shown in FIG. 7, the detection temperature of the thermistor 105F lowers more abruptly than the detection temperature of the thermistor 105R. Then, when the time change rate ΔT/s of the differential temperature ΔT exceeds 10° C., the crack detection can be made.

Incidentally, in the above-described embodiment, the case in which the crack generated on the F side of the fixing film 101 was described as an example, but even in the case in which the crack generated on the R side, the crack can be detected by the thermistor 105R similarly as in the case in which the crack generated on the F side.

Modified Embodiment 2

In the above-described embodiment, the temperature difference ΔT between the respective detection temperatures of the first and second temperature detecting members (i.e., the thermistors 105F and 105R) was calculated, and, on the basis of the time change rate ΔT/s of the calculated temperature difference ΔT, the controller 107 provided notification of an abnormality (generation of the crack) of the fixing film 101, but the present invention is not limited thereto. On the basis of the time change rate ΔT/s of at least one of the respective detection temperatures of the first and second detecting members, the controller 107 may also provide notification of an abnormality (generation of the crack) of the fixing film 101.

Further, a single temperature detecting member, rather than the plurality of temperature detecting members, such as the first and second temperature detecting members, is provided, and, on the basis of the time change rate ΔT/s of the detection temperature ΔT, the controller 107 may also provide notification of an abnormality (generation of the crack) of the fixing film 101. When the abnormality (generation of the crack) of the fixing film 101 is notified on the basis of the time change rate ΔT/s of the detection temperatures of the plurality of temperature detecting members, however, the crack can be detected more quickly irrespective of a place where the crack generates, by using the time change rate ΔT/s of the differential temperature ΔT between the detection temperatures of the plurality of temperature detecting members, and thus, the use of the plurality of temperature detecting members is preferable.

Modified Embodiment 3

In the above-described embodiment, the control by the time change rate ΔT/s of the differential temperature ΔT between the thermistor 105F on one end portion side with respect to the widthwise direction, and the thermistor 105R on the other end portion side with respect to the widthwise direction was shown, but the present invention is not limited thereto. For example, control by the time change rate ΔT/s of the differential temperature ΔT between the thermistor 105F (or the thermistor 105R) and the thermistor 105C at the central portion with respect to the widthwise direction may also be employed. Further, in a fixing device constitution in which a plurality of temperature detecting members differ in the number of the temperature detecting members as compared to this embodiment, even when a combination providing a pair of temperature detecting members, such that at least one temperature detecting member is in the neighborhood of the non-sheet-passing portion, is used, control by the time change rate ΔT/s of the differential temperature ΔT of the thermistor pair can be carried out.

Modified Embodiment 4

The image heating apparatus 40 according to the present invention includes the control providing notification of an abnormality of the fixing film 101 on the basis of the time change rate ΔT/s of the detection temperatures. This controller 107 is not limited to a controller (CPU provided in the image forming apparatus) for carrying out both of control relating to the image formation and control relating to image heating (fixing). That is, the controller 107 may also be a controller exclusively carrying out the control relating to the fixing.

Further, the image heating apparatus 40 according to the present invention is not limited to one fixedly provided in the image forming apparatus 500, but may also be one that is assembled as a unit and that can be demounted to an outside of the image forming apparatus 500 and then can be exchanged. In this case, the image heating apparatus 40 may be demounted and exchanged inclusive of the controller 107, and may also be demounted and exchanged exclusive of the controller 107. Further, the image heating apparatus 40 according to the present invention may also be used alone as the image heating apparatus 40 independently of the image forming apparatus 500.

Modified Embodiment 5

In the above-described embodiment, the endless belt (i.e, the fixing film 101) provided on the first rotatable member (i.e., the press-contact member 103) was described, but the endless belt was provided on the second rotatable member (i.e., the pressing roller 106). Further, an endless belt may also be provided on both of the first and second rotatable members.

Further, in the above-described embodiment, a case in which the rotatable pressing member (i.e., the pressing roller 106) as the second rotatable member and as the pressing member that is pressed by the rotatable fixing member (i.e., the fixing film 101) was described. The present invention is not limited, however, thereto, but is similarly applicable to a case in which the second rotatable member is an opposing member, but is not the pressing member that is pressed by the fixing belt (film) as the rotatable fixing member. Here, the opposing member opposes the rotatable fixing member and forms a fixing nip N in press-contact with the rotatable fixing member for nipping a moving the recording material S at the fixing nip N.

In the above-described embodiment, as the pressing member 106, the rotatable pressing roller member rotating together with the rotatable fixing member was used, but the present invention is not limited thereto, and may also be applicable to a flat plate-shaped pressing pad fixed as the pressing member 106.

Further, in the above-described embodiment, as the recording material S, the recording paper was described, but the recording material S in the present invention is not limited to the paper. In general, the recording material S is a sheet-shaped member on which the toner image is formed by the image forming apparatus 500, and includes, for example, regular or irregular members of plain paper, thick paper, thin paper, an envelope, a post-card, a seal, a resin sheet, an OHP sheet, glossy paper, and the like. In the above-described embodiment, for convenience, dealing of the recording material (sheet) S was described using terms, such as the sheet passing, the sheet passing portion, the non-sheet-passing portion, but by this description, the recording material S in the present invention is not limited to the paper.

Further, in the above-described embodiment, the fixing device for fixing the unfixed toner image on the sheet S was described as an example, but the present invention is not limited thereto, and is also similarly applicable to an apparatus for heating and pressing a toner image, temporarily fixed on the sheet S, in order to improve glossiness of the image.

INDUSTRIAL APPLICABILITY

Provided is an image heating apparatus capable of properly detecting an abnormality of the fixing belt (film) of the fixing device of the image forming apparatus.

The invention claimed is:

1. An image heating apparatus comprising:

an endless belt for heating a toner image on a sheet;

a first detector for detecting a temperature of one longitudinal end portion of said endless belt;

a second detector for detecting a temperature of the other longitudinal end portion of said endless belt; and a controller for controlling whether notification of generation of an error is provided on the basis of a change amount per unit time of a difference between the temperature detected by said first detector and the temperature detected by said second detector.

2. An image heating apparatus according to claim 1, wherein, when the change amount per unit time exceeds a predetermined value, said controller provides the notification of the generation of the error.

3. An image heating apparatus according to claim 2, wherein, when the change amount per unit time is not more than the predetermined value, said controller does not provide the notification of the generation of the error.

4. An image heating apparatus according to claim 2, further comprising a plate-shaped heater, elongated in a longitudinal direction of said endless belt, for heating said endless belt, wherein said first detector and said second detector are provided on said plate-shaped heater.

5. An image heating apparatus according to claim 1, wherein, when the change amount per unit time exceeds a predetermined value, said controller provides the notification of the generation of the error, and prohibits execution of an image heating process.

6. An image heating apparatus according to claim 5, wherein, when the change amount per unit time is not more than the predetermined value, said controller does not provide the notification of the generation of the error, and permits the execution of the image heating process.

7. An image heating apparatus according to claim 1, wherein, when the change amount per unit time exceeds a predetermined value during execution of an image heating process, said controller provides the notification of the generation of the error, and interrupts execution of the image heating process.

8. An image heating apparatus according to claim 7, wherein, when the change amount per unit time is not more than the predetermined value during the execution of the image heating process, said controller does not provide the notification of the generation of the error, an continues the execution of the image heating process.

9. An image heating apparatus according to claim 1, wherein said error is breakage of said endless belt.

10. An image heating apparatus according to claim 1, further comprising a rotatable member for nipping and feeding the sheet between itself and said endless belt, and for rotationally driving said endless belt.

11. An image heating apparatus according to claim 10, further comprising:

a first preventing portion, provided so as to be capable of being abutted against one longitudinal end of said endless belt, for preventing movement of said endless belt from the other longitudinal end of said endless belt toward the one longitudinal end, and a second preventing portion, provided so as to be capable of being abutted against said the other longitudinal end of said endless belt, for preventing movement of said endless belt from the one longitudinal end toward the the other longitudinal end.

* * * * *